US005494117A

United States Patent [19]

Aldridge

[11] Patent Number: 5,494,117

[45] Date of Patent: Feb. 27, 1996

[54] METAL FENCE POST DRIVER

[76] Inventor: B. Hunter Aldridge, P. O. Box 2104, Duncan, Okla. 73534

[21] Appl. No.: 185,339

[22] Filed: Jan. 24, 1994

[51] Int. Cl.[6] ..... E02D 7/10

[52] U.S. Cl. ..... 173/28; 173/90; 173/184

[58] Field of Search ..... 173/27, 28, 147, 173/90, 128, 184; 405/232, 249; 30/379, 379.5

[56] References Cited

U.S. PATENT DOCUMENTS

| | | | |
|---|---|---|---|
| 2,659,583 | 11/1953 | Dorkins | 173/27 X |
| 2,844,006 | 3/1955 | Lutz et al. . | |
| 3,117,635 | 1/1964 | Deerkoski | 175/135 |
| 3,696,625 | 10/1972 | Alexander | 61/53.5 |
| 4,051,684 | 10/1977 | Fulkerson et al. | 173/128 X |
| 5,010,710 | 4/1991 | Gray et al. | 173/90 X |
| 5,107,592 | 4/1992 | Downey et al. | 30/379.6 X |
| 5,211,248 | 5/1993 | Nosewicz et al. | 173/28 X |
| 5,343,962 | 9/1994 | Daigle et al. | 173/147 |

FOREIGN PATENT DOCUMENTS

| | | | |
|---|---|---|---|
| 629093 | 10/1961 | Canada | 173/27 |

*Primary Examiner*—Rinaldi I. Rada
*Attorney, Agent, or Firm*—Robert K. Rhea

[57] ABSTRACT

A metal fence post driving apparatus is formed by a platform rearwardly supported by the three point hitch of a conventional tractor and having a fluid pressure generating unit on the platform driven by the tractor power takeoff. A mast having a top end portion rotatable about its vertical axis pivotally supports a boom intermediate its ends for horizontal and vertical pivoting movement of its respective end portions by a first fluid pressure operated cylinder. A second fluid pressure cylinder pays out and retracts one end portion of the wire line of a block and tackle unit for elevating and lowering a fluid pressure operated reciprocating unit axially disposed on a post top to be driven into the ground.

6 Claims, 3 Drawing Sheets

METAL FENCE POST DRIVER

BACKGROUND OF THE INVENTION

This invention relates to fence building and more particularly to a mobile machine and unit for forcing fence posts into the surface of the earth.

1. Field of the Invention

It is known to utilize a drop hammer mounted on the bed or frame of a truck for forcing posts into the surface of the earth. However, a drop hammer has several drawbacks. For example, on account of the mass of a drop hammer the frame supporting it for vertical reciprocating movement must be rigidly attached to the bed or frame of a truck. Further, accurate soil penetrating depth is not easily controlled and a drop hammer usually damages the top end of the relatively thin gauge wall of tubular chain link fence posts.

This presents additional problems, for instance, it is not likely that the drop hammer will drive vertically when the wheels of the truck are located on uneven ground in the field or location adjacent the site where the post must be driven. Attempting to orient the drop hammer supporting frame vertically requires considerable time and effort on the part of more than one workman which delays the work progress and increases the cost thereof.

Further, in wire fences for confining substantially any animal within or out of a selected area, the fence wire height varies in accordance with the animals to be confined. For example, 12 to 15 or more feet (3.66 to 4.57M) as opposed to 5 to 8 feet (1.52 to 2.44M). The posts supporting a wire fence must have a similar height.

This invention overcomes the above outlined problems by providing a post driving unit mounted upon a mobile vehicle in which the post driver supporting beam is horizontally rotatable and vertically pivotable for accommodating substantially any post length in the above described range desired to be driven into the surface of the earth. The axis of the driving unit is vertically oriented by gravity.

2. Description of the Prior Art

U.S. Pat. No. 2,844,006, issued Jul. 22, 1958 to Lutz et al for POST DRIVER ATTACHMENT discloses a pair of tractor mounted booms hydraulically pivoted vertically at their ends opposite the tractor for supporting a drop hammer frame pivotally connected with the ends of the booms remote from the tractor.

The drop hammer frame is supported from the booms by horizontal right angular disposed mounting axes permitting the depending end portion of the drop hammer frame to be plumbed by gravity when positioned over the upper end of a post being driven into the ground. The drop hammer is lifted by tractor power and released for impacting on the top of the post to perform the desired action.

U.S. Pat. No. 3,117,635 issued Jan. 14, 1964 to Terry Industries for SELF-PROPELLED POST DRIVER discloses a post driving apparatus mounted on a tractor supplying hydraulic and air power for operating a jack hammer depending from a boom mounted on a mast for movement in two generally horizontal orthorgonal axes. The mast is pivotally mounted on the tractor and a pair of cylinders are manipulated to orient the mast vertically and afford versatility and placement of the post.

Other state-of-the-art patents generally relate to road working machines or to a combination auger and post driver such as disclosed by U.S. Pat. No. 3,696,625, issued Oct. 10, 1972 to Alexander for POST IMPLANTING METHOD AND VEHICULAR APPARATUS THEREFOR.

This patent provides a truck mounted auger which bores a hole at the post site and subsequently drives a post, by a drop hammer, into the hole previously excavated.

This invention is distinctive over the above named and other patents by removably mounting a post driving apparatus on the rearward end portion of a farm tractor. The post driving apparatus includes a horizontally rotating and vertically pivoting boom and a wire line block and tackle supporting an air pressure driven impact hammer vertically oriented by gravity.

SUMMARY OF THE INVENTION

The post driving apparatus comprises a platform horizontally supported rearwardly by a tractor three point hitch.

An air compressor and reservoir is mounted on the platform which also supports a mast horizontally pivotal about its vertical axis at its upper end portion which in turn pivotally supports a boom intermediate its ends. A source of fluid pressure drives a fluid pressure cylinder for raising and lowering the respective ends of the boom.

A wire line block and tackle secured to the remote end of the boom is connected by a fluid pressure cylinder to the boom near its pivot point. The wire line is connected with and raises and lowers a hydraulic post driver having a chuck which receives the top end of a post to be driven vertically into the surface of the earth.

The principal objects of this invention are to provide a tractor supported post driving apparatus capable of vertically driving a post at any position, relative to the rearward end portion of a tractor, throughout an arc of substantially 270° and which is capable of driving fence posts of required lengths for chain link, game, farm and ranch fencing or highway projects.

DESCRIPTION OF THE PREFERRED EMBODIMENTS

Figure 1:
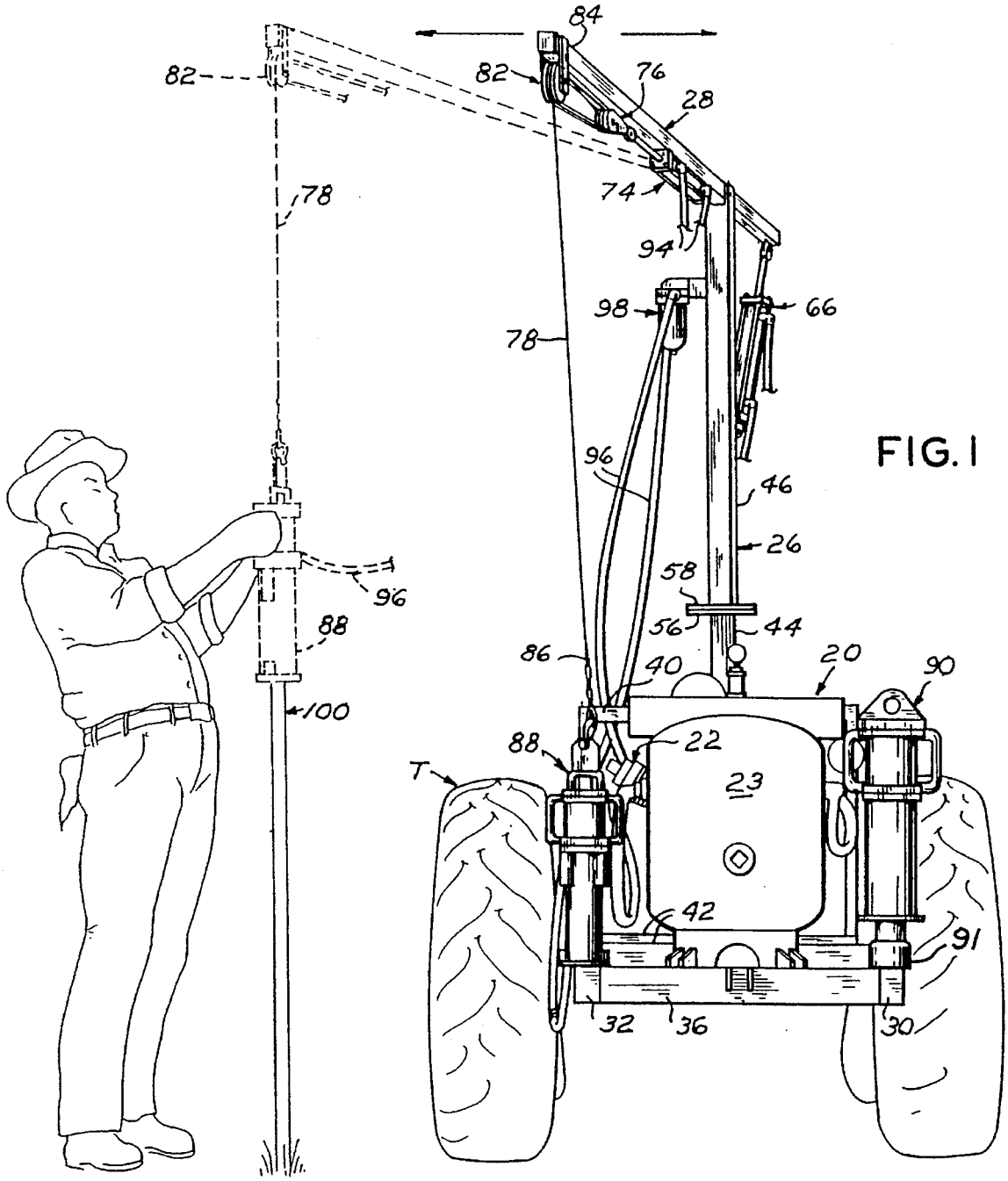
FIG. 1 is a rearward perspective view of the apparatus illustrating, by dotted lines, a typical post driving action.
Figure 2:
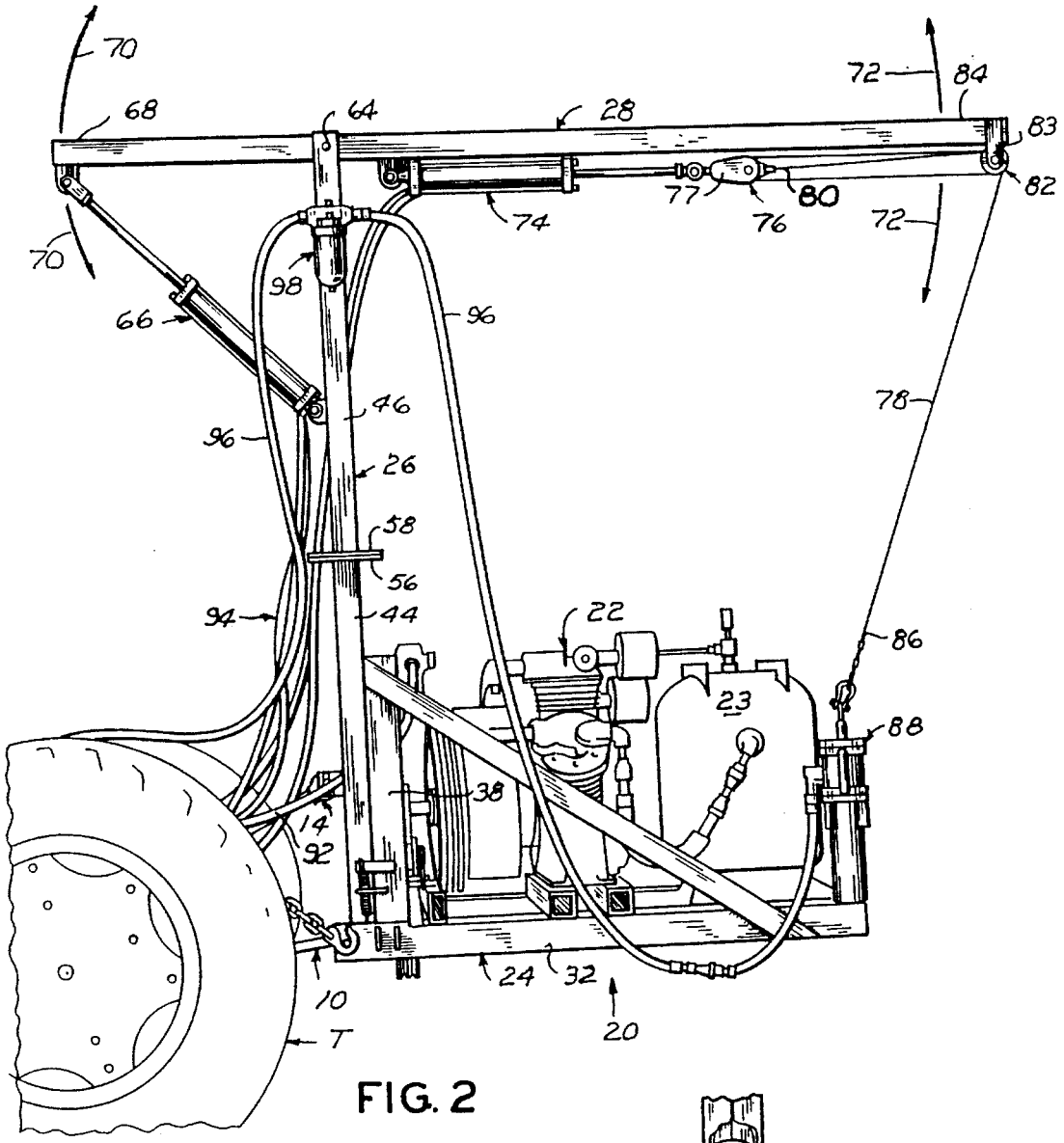
FIG. 2 is a side elevational view of the post driving apparatus mounted on a tractor, shown fragmentarily.

Like characters of reference designate like parts in those figures of the drawings in which they occur.

Figure 4:
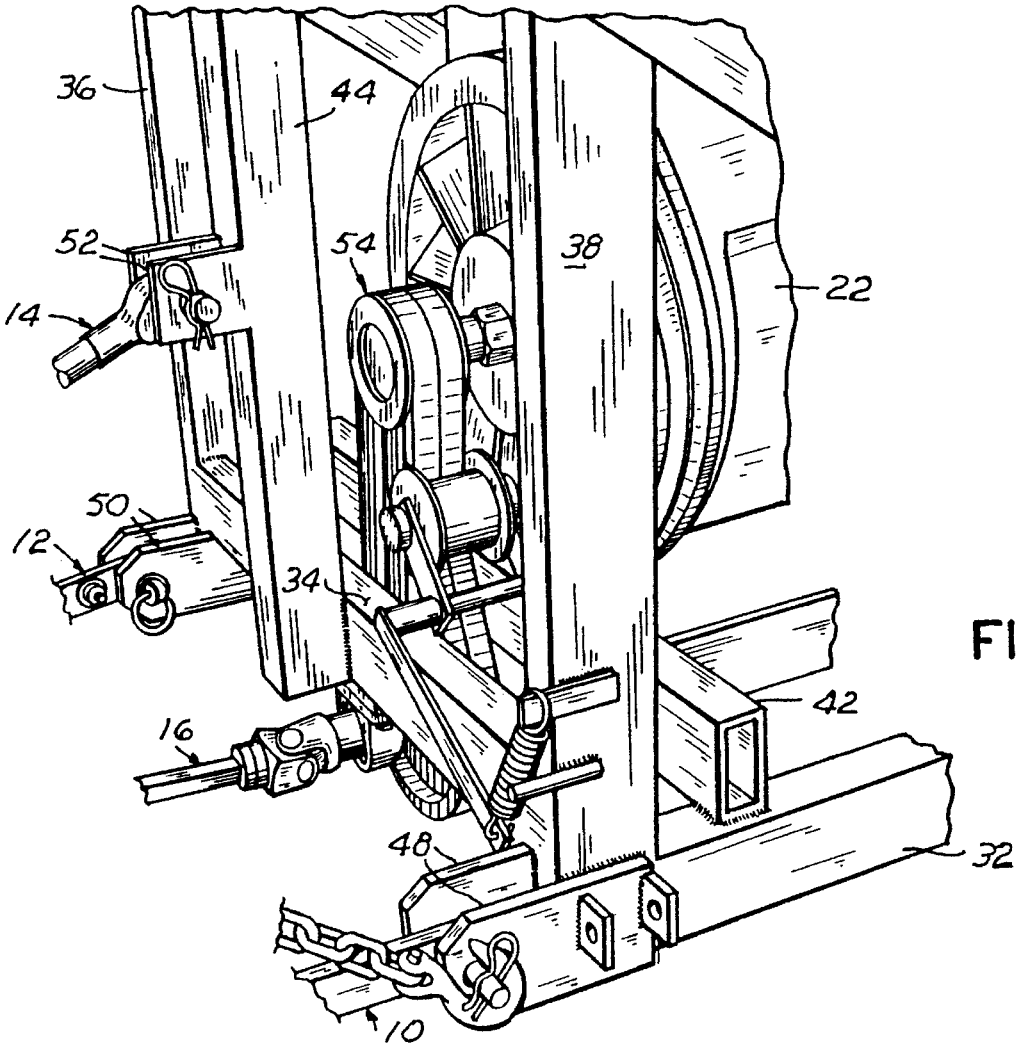

In the drawings:

The reference letter T indicates a conventional mobile tractor having a chassis and having a three point hitch, indicated at 10, 12 and 14 (FIG. 4) and a power take-off 16. The three point hitch supports a post driving apparatus 20 including a conventional air compressor 22 having a reservoir 23 on a horizontal platform 24 supporting a mast 26 in turn supporting an elongated boom 28.

The platform 24 comprises an open frame formed by right and left side members 30 and 32 interconnected at their forward and rearward end portions by horizontal cross members 34 and 36. The forward end portions of the side members 30 and 32 support a pair of standards 36 and 38, respectively, interconnected at their upper limit by a top cross member 40.

Other frame cross members 42, intermediate the ends of the frame 24, support the air compressor 22 and its tank or reservoir 23.

The mast 26 is formed in two sections, a lower section 44 and an upper or top section 46. The lower section 44 of the mast is rigidly connected in upstanding relations medially the width of the forward cross member 44 and top member 40 as by welding.

The forward end portion of the frame side members 30 and 32 and the depending end portion of the mast lower section 44 are provided with three forwardly open clevis-like members 48, 50 and 52 respectively receiving the three point hitch members 10, 12 and 14.

Belt and pulley means 54 driven by the power take-off 16 drives the air compressor 22.

The abutting ends of the lower and upper mast sections 44 and 46 are each rigidly connected, respectively, with a lower disk 56 and upper disk 58 with the planes of the disks parallel and perpendicular to the longitudinal axis of the mast sections 44 and 46 to form a bearing surface permitting angular rotation of the upper section 46 relative to the lower section 44. Obviously the disks, 56 and 58 may be cooperatively notched or apertured not shown, to index the top disk relative to the lower disk.

Figure 3:
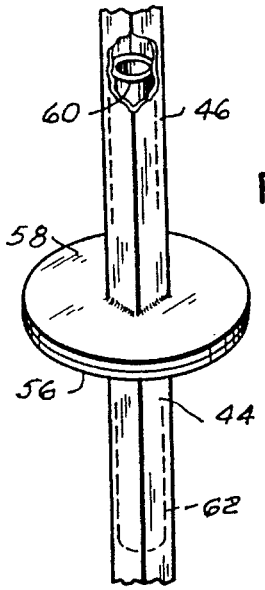
FIG. 3 is a fragmentary perspective view with parts broken away, illustrating the manner of pivotally mounting the upper end portion of a mast; and, FIG. 4 is a fragmentary perspective view illustrating the manner of mounting the post driving apparatus on the three point hitch and power take-off drive of a conventional tractor.

The mast sections 44 and 46 are axially joined together for this pivoting relationship by an elongated tube 60 (FIG. 3) secured at its depending end portion 62 to the inner wall surface of the upper end portion of the lower mast section 44. The upper end portion of the tube projects into the lower end portion of the top mast section 46. Thus, forming an axle journalling the upper mast section 46 for angular rotation with its disk 58 forming a bearing surface supporting the mast top section and the boom.

The upper end portion of the mast section 46 is bifurcated and receives a pin 64 extending transversely through one end portion of the boom 28 and forming a horizontal pivoting axis for the boom during vertical movement of its respective end portions about the axis of the pin 64 as presently explained.

A fluid pressure operated cylinder 66 has its cylinder end pivotally connected to an intermediate portion of the upper mast section 46 and its piston rod pivotally connected to an end portion 68 of the boom for raising and lowering the boom end portions in the direction of the arrows 70 and 72.

A second fluid pressure operated cylinder 74 has its cylinder end pivotally connected to the depending surface of the boom adjacent the mast section 46 opposite the piston rod connected end of the cylinder 66.

The piston rod of the cylinder 74 is connected with a first set of sheaves 76 journalled by a block 77. A wire line 78 has its dead end portion 80 connected with the sheave block 77 and is strung in tackle block fashion between the sheaves 76 and a second set of sheaves 82 journalled between strap iron members 83 depending from the forward end portion 84 of the boom.

The other end portion 86 of the wire line 78 is connected with a conventional compressed air operated post driver unit 88. The post driver unit 88 may be obtained from Rhino Tool Co., P.O. Box 111, 620 Andrews Ave., Kewana, Ill. 61443. The post driver 88 is normally supported by the frame 24. A second heavy duty post driver unit 90 is also supported by the frame.

A flexible tube 92 supplies air from the reservoir 23 to valve controls, not shown, on the tractor operated by a tractor operator. Other tubing 94 from the valve controls supply air pressure to the first and second pressure cylinders 66 and 74 and additional tubing 96 connects the valve controls to the post driver unit 88 through a lubricator 98.

Obviously the tractor T may include a source of hydraulic fluid under pressure for operating the fluid pressure cylinders.

OPERATION

In operation the apparatus 20 is assembled and mounted on the tractor T as described hereinabove.

The tractor T is positioned adjacent a predetermined line on which a fence is to be erected.

The tractor driver by operating the second pressure cylinder 74 lifts the post driver 88 off the frame 24 and positions it conveniently for a workman to insert the top end portion of a post 100 into the downwardly open chuck of the post driver 88.

The boom 28 is horizontally pivoted by the workman moving the upper end portion of the post and driver toward a plumb position for the post which angularly rotates the boom and top portion 46 of the mast. If not vertically aligned with the post the driver moves the tractor to a position where the second set of sheaves 82 are substantially vertically disposed above the position in which the post 100 is to be driven into the surface of the earth.

The mass of the post driver 88 is principally supported by the upper end of the post and the workman steadies and plumbs the post while the post driver reciprocating piston progressively moves the post into the surface of the earth to a desired depth.

In the event a post of greater length than the post 100 is used the boom may be elevated in the direction of the arrow 72 by the tractor operator retracting the piston rod of the cylinder 66.

Obviously the invention is susceptible to changes or alterations without defeating its practicability. Therefore, I do not wish to be confined to the preferred embodiment shown in the drawings and described herein.

I claim:

1. A post driver attachment for use with a mobile prime mover having a source of power and a plurality of attachment supports, comprising:

a frame having a horizontally disposed portion and an upstanding end portion supported by said prime mover attachment supports;

a source of fluid under greater than atmospheric pressure;

a mast supported by said frame end portion;

an elongated boom having opposing end portions pivotally supported intermediate its end portions by said mast for horizontal pivoting movement about a vertical axis and vertical pivoting movement of its respective end portions about a horizontal axis;

a first fluid pressure cylinder interposed between said mast and one end portion of said boom for elevating or lowering respective end portions of said boom;

block and tackle means including an elongated flexible element supported by said other end portion of said boom;

a second fluid pressure cylinder interposed between said block and tackle means and the boom for paying out and winding up one end portion of said flexible element;

a fluid pressure operated post driver unit supported by said flexible element and having a post end portion receiving chuck and having a vertically reciprocating plunger intermittently contacting the top end of a post contained by said chuck; and, tubing operatively connecting the source of fluid pressure with said first and second cylinders and the post driver unit.

2. The post driver attachment according to claim 1 in which said source of fluid comprises:

an air compressor supported by said frame and driven by said tractor source of power; and, an air reservoir.

3. The post driver according to claim 1 in which said block and tackle means includes:

said second pressure cylinder connected at one end with said boom opposite the first pressure cylinder;

a first set of sheaves connected with and supported by the other end of said second pressure cylinder; and, a second set of sheaves supported by said other end portion of said boom, said flexible element operatively strung between said first and second sets of sheaves and having an elongated end portion for movement toward and away from the surface of the earth.

4. A post driver attachment for use with a mobile prime mover having a source of power and a plurality of attachment supports, comprising:

a frame supported by said prime mover attachment supports;

a source of fluid under greater than atmospheric pressure;

a mast supported by said frame;

an elongated boom having opposite end portions pivotally supported intermediate its end portions by said mast for horizontal pivoting movement about a vertical axis and vertical pivoting movement of at least one end portion about a horizontal axis;

a first pressure cylinder interposed between said mast and said boom for elevating and lowering the end portions of said boom;

block and tackle means including an elongated flexible element supported by the end portion of said boom opposite the first pressure cylinder;

a second pressure cylinder interposed between said block and tackle means and said boom for paying out and winding up one end portion of said flexible element;

a fluid pressure operated post driver unit supported by said flexible element one end portion and having a post end portion receiving chuck and having a vertically reciprocating plunger intermittently contacting the top end of a post contained by said chuck; and, tubing operatively connecting the source of fluid pressure with said first and second cylinders and the post driver unit.

5. The post driver attachment according to claim 4 in which said source of fluid comprises:

a fluid compressor; and, a fluid reservoir operatively connected with the compressor.

6. The post driver according to claim 4 in which said block and tackle means further includes:

a first set of sheaves connected with and supported by said second pressure cylinder; and, a second set of sheaves supported by the end portion of said boom opposite the first pressure cylinder, said flexible element operatively strung between said first and second sets of sheaves and having an elongated end portion for movement toward and away from the surface of the earth.

* * * * *